US005642595A

United States Patent [19]

Daniels et al.

[11] Patent Number: 5,642,595

[45] Date of Patent: Jul. 1, 1997

[54] FINIAL ATTACHMENT ARRANGEMENT FOR A WINDOW COVERING SUPPORT ROD

[75] Inventors: James L. Daniels; Christopher T. Chiles, both of Freeport, Ill.

[73] Assignee: Newell Operating Company, Freeport, Ill.

[21] Appl. No.: 603,446

[22] Filed: Feb. 20, 1996

[51] Int. Cl.[6] ..... E04C 3/00

[52] U.S. Cl. ..... 52/301; 52/720.2; 52/726.1; 52/745.16; 160/330; 211/78; 211/105.1

[58] Field of Search ..... 52/301, 720.2, 52/276.1, 745.16; 211/78, 105.1; 160/330

[56] References Cited

U.S. PATENT DOCUMENTS

| | | | |
|---|---|---|---|
| 668,923 | 2/1901 | Muehlenbach | 160/330 |
| 784,312 | 3/1905 | Evans | 160/330 |
| 1,188,485 | 6/1916 | Pruyn | 52/726.1 X |

OTHER PUBLICATIONS

Springs Window Fashions Division, Inc. (Dec. 1994) Wrought Iron Finial Installation Instructions.

*Primary Examiner*—Christopher T. Kent
*Attorney, Agent, or Firm*—Foley & Lardner

[57] ABSTRACT

A finial support arrangement is provided for window coverings and the like, including a hollow ended support rod or tube, a support sleeve lodged within the rod, and a decorative finial supported in and by the sleeve. The finial includes a support post that is force or interference fitted into the sleeve. The sleeve, in turn, is force or interference fitted into the tube. The sleeve is made of a material that is softer than the support post and may be deformed during insertion of the post. The arrangement is particularly useful for supporting cast or wrought metal finials in rigid support tubes or rods, and alleviates the need for close tolerances on either the tube interior diameter or the support post outer diameter that would otherwise be needed to provide the desired interference fit.

15 Claims, 1 Drawing Sheet

FINIAL ATTACHMENT ARRANGEMENT FOR A WINDOW COVERING SUPPORT ROD

BACKGROUND OF THE INVENTION

The present invention relates generally to an arrangement for attaching a decorative finial to a window covering support rod. More particularly, the invention relates to an arrangement for securing a finial to a hollow support rod by pressing an extension on the finial into a sleeve or bushing made of a material softer than the material comprising the finial.

In the field of window coverings, various techniques are employed for supporting draperies and the like over a window. These techniques typically include the use of a support rod secured to a wall or window frame by cantilevered brackets. The rods often carry rings or other intermittent support devices holding the draperies, which may be manually or mechanically movable along the support rod to cover or uncover the window opening. Alternatively, the draperies may be hung directly on the support rods. The ends of the rods are commonly either covered by the draperies or exposed, extending beyond either side of the window opening.

A common decorative technique used in conjuction with exposed ends of window covering support rods involves the use of finials that terminate the support rods with an attractive element. Although such finials may be supported in a variety of ways, they are typically either fitted within the rods, around the rods or both within and around the rod ends. Portions of the finials may be tapered or dimensioned to provide an interference fit within or around the rod ends to provide a secure hold of the finial on the rod. Additional securing devices may be included in a finial attachment portion, such as set screws designed to engage the support rod to provide a retaining force preventing removal of the finial.

While these finial attachment arrangements are generally adequate for many types of finials and support rods, they are not without drawbacks. For example, where rigid rods are used, such as relatively heavy wall or welded seam rods, pressing an interference fit finial into the rod may be difficult or impossible. Moreover, where finials having large or heavy decorative sections are used, the interference fit may not be sufficient to hold the finial securely in the desired position. In addition, where finials are made of a particularly hard material, such as cast or wrought metal, the required interference fit may be very difficult or impossible to obtain through common manufacturing practices without incurring excessive costs. This is particularly true for sand castings and the like, where dimensional tolerances are relatively large.

There is a need therefore, for an improved arrangement for attaching and supporting a decorative finial in a window covering support rod. In particular, there is a need for a finial support arrangement that is both simple and economical to fabricate and use, and that provides effective support for various types of finial, including relatively large or heavy finials, and finials made of hard materials such as cast or wrought metal.

SUMMARY OF THE INVENTION

The invention provides a novel arrangement for securing a decorative finial to a window covering support rod or tube designed to respond to these needs. In accordance with one aspect of the invention, a window covering support includes, in combination, a hollow support tube, a pair of decorative finials and a pair of support sleeves. The support tube terminates in open end. The finials are supported in the open ends of the tube and each include a decorative portion and a generally cylindrical support post extending from the decorative portion into an end of the support tube. The support sleeves are lodged within the ends of the support tube intermediate the support tube and the support post of respective finials. The support sleeves are compressed by the support tube and the finial support posts to maintain a tight fit, such as a friction, interference or pressure fit, therebetween and thereby to support and retain the finial on the support tube.

In accordance with another aspect of the invention, a window covering support includes a support rod, first and second decorative finials, and first and second support sleeves. The support rod has first and second hollow ends, and the finials are supported on respective ends of the rod. Each finial includes a decorative portion and a rigid support post. The support sleeves are disposed intermediate the first and second ends and the first and second finials respectively. The support sleeves have outer surfaces conforming to inner surfaces of the hollow ends, and inner surfaces configured to engage the support posts in an interference fit to support and retain the finials on the support rod.

The invention also provides an innovative method for supporting a decorative finial on a support rod. In accordance with this aspect of the invention, the finial is provided with an elongated support post for supporting it on the support rod. The method includes the steps of pressing a support sleeve into a hollow end of the support rod, the support sleeve being made of a material softer than the finial support post. The finial support post is pressed into the support sleeve to establish an interference fit between the support post and the support sleeve. The support sleeve is preferably provided with a stop or lip to limit its insertion into the support rod. The support post is preferably similarly provided with a stop, as well as with a tapered tip for facilitating its insertion into the support sleeve.

BRIEF DESCRIPTION OF THE DRAWINGS

The present invention will become more fully understood from the following detailed description, taken in conjunction with the accompanying drawings, wherein like reference numerals refer to like parts, in which.

DESCRIPTION OF THE PREFERRED EMBODIMENTS

Figure 1:
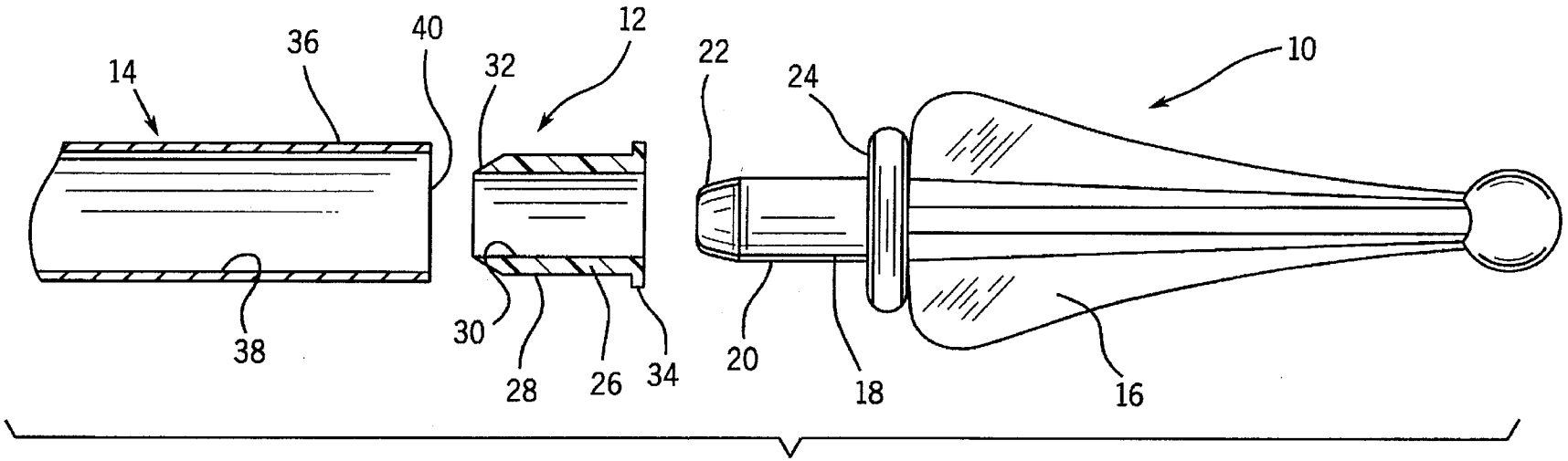
FIG. 1 is an exploded view of a finial, support sleeve and support rod or tube prior to assembly, the latter two elements being shown in section to illustrate their preferred construction.

Turning now to the drawings and referring to FIG. 1, one end of a window covering support is illustrated as including a decorative finial 10, a support sleeve 12 and a support rod or tube 14. Although only one end of the support arrangement is illustrated in FIG. 1, it will be understood that the arrangement includes a second end of substantially identical construction. It should also be understood that support rod or tube 14 will typically be installed over a window opening, door, or similar location through the use of cantilevered support brackets (not shown) or the like, and that a drapery, curtain or other covering (not shown) will be hung therefrom. Because such support brackets and window coverings are, in themselves, well known in the art and form no part of the present invention, they have not been illustrated and will not be described in detail.

As shown in FIG. 1, finial 10 includes a decorative portion 16 and a support post 18 extending therefrom. Support post 18 has a generally cylindrical external surface 20 terminating in a tapered tip 22. An abutment surface or stop 24 is preferably formed at an extremity of post 18 opposite tip 22, such as in the region where post 18 joint decorative portion 16. It should be noted that, while in the preferred embodiment illustrated post 18 is round in cross section, it could have any cross sectional shape, such as square or diamond shaped. Moreover, while in the preferred embodiment finial 10 is cast or wrought from metal to form a single piece construction, it could also be formed of other materials, such as moldable plastics, and could be assembled from two or more pieces of the same or different material. As described more fully below however, the present arrangement is particularly well suited to supporting cast or wrought metal finials.

Support sleeve 12 is formed of a hollow, cylindrical wall portion 26 having an outer surface 28 and an inner surface 30. At one end, wall portion 26 terminates in a tapered or chamfered tip, while at an opposite end, wall portion 26 includes an annular abutment lip or stop 34 extending outwardly from outer surface 28. Support sleeve 12 is preferably made of a moldable plastic material and is substantially softer than the material comprising support post 18. In the presently preferred embodiment, sleeve 12 is made of polypropylene, such as Amoco 1016.

Support tube 14 may be a fully hollow, tubular structure or, alternatively, may be a solid rod hollow only in the vicinity of its ends. Such support rods are well known in the art and are typically made of steel, aluminum, brass or a plastic material. Tube 14 includes a generally cylindrical side wall 36 having an inner surface 38 and terminating in an end surface 40. While tube 14 may be a rolled tube having a longitudinal split as is common in the art, the present arrangement is particularly adapted or use with rigid support rods or tubes having little or no radial flexibility (e.g. seamless tubes, welded tubes, etc.).

Figure 2:
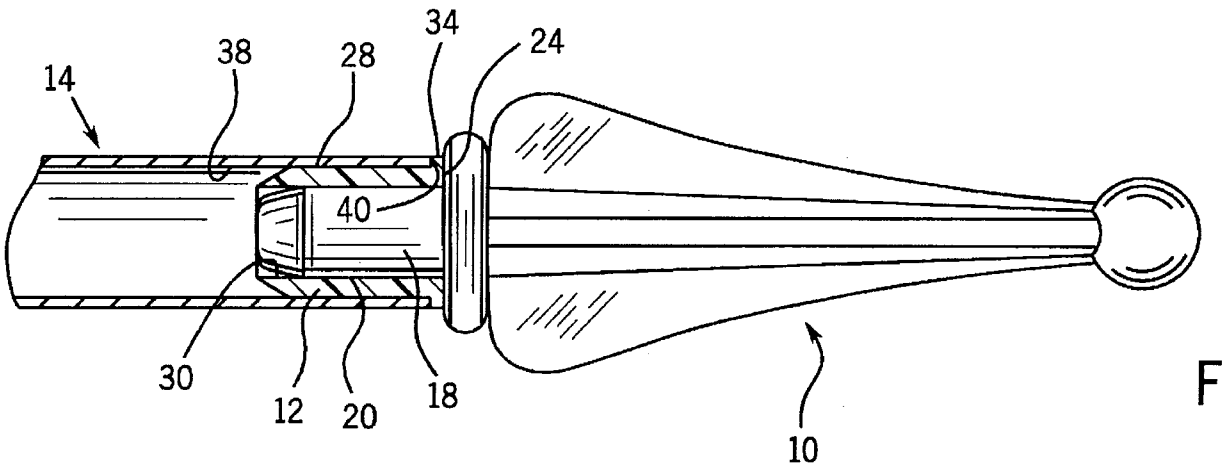
FIG. 2 is a view of the elements shown in FIG. 1 after assembly.

Finial 10, sleeve 12 and support tube 14 are assembled as illustrated in FIG. 2. After mounting tube 14 in a conventional manner and hanging a drapery or the like therefrom, support sleeve 12 is pressed into the end of tube 14. Outer surface 28 of sleeve 12 is preferably dimensioned with respect to inner surface of tube 14 to provide some degree of force or interference fit therebetween. Tapered tip 22 of sleeve 12 facilitates its centering and insertion into tube 14. Sleeve 12 is pressed in this manner into tube 14 until abutment or stop 34 contacts end surface 40, thus preventing any further insertion of sleeve 12. Finial 10 is then installed within tube 14 by pressing support post 18 into sleeve 12. Outer surface 20 of post 18 is preferably dimensioned with respect to inner surface 30 of sleeve 12 to provide a force or interference fit therebetween. Tapered tip 22 of post 18 facilitates its insertion into sleeve 12 and stop surface 24 limits its insertion. A similar operation is performed on the opposite end of tube 14 to complete the installation.

As will be appreciated by those skilled in the art, once installed, finial 10 is solidly supported in tube 14 by virtue of the tight fits between the tube inner wall surface 38 and the outer surface 28 of sleeve 12 and between the inner surface 30 of sleeve 12 and the outer surface 20 of support post 18. By providing sufficient engagement lengths between these surfaces, the arrangement described above may be adapted for supporting finials having considerable weight. Moreover, because support sleeve 12 is preferably made of a material that is softer than support post 18, sleeve 12 may be deformed during installation of finial 10. This feature of the arrangement is particularly useful for mounting cast or wrought metal finials in rigid tubes or rods, alleviating the need for close tolerances on the finial support post. Moreover, because sleeve 12 may be somewhat elastically deformed during installation of finial 10, finial 10 may be force or interference fitted into tube 14, removed therefrom, and subsequently replaced without plastically deforming either tube 14 or support post 18 in a manner that would gradually deteriorate the desired fit therebetween.

While the embodiments illustrated in the Figures and described above are presently preferred, it should be understood that these embodiments are offered by way of example only. The invention is not intended to be limited to any particular embodiment, but is intended to extend to various modifications that nevertheless fall within the scope of the appended claims. For example, while the mating surfaces of tube 14, sleeve 12 and post 18 generally conform to one another to provide the fits described, these surfaces have any desired radial shape. Moreover, it may be desirable in certain cases to provide discontinuous or intermittent surfaces on some or all of these members, such as surfaces having star or splined cross sections.

We claim:

1. A window covering support comprising in combination:

a hollow support tube terminating in open ends;

a pair of decorative finials, one of the decorative finials being supported within each end of the support tube, each finial including a decorative portion and a generally cylindrical support post extending from the decorative portion into an end of the support tube; and a pair of support sleeves, one of the support sleeves being lodged within each end of the support tube intermediate the support tube and the support post of a respective finial, the support sleeves being compressed by the support tube and the finial support posts to maintain a tight fit therebetween and thereby to support and retain the finial on the support tube.

2. The window covering support of claim 1, wherein the support tube is a rigid metal tube.

3. The window covering support of claim 1, wherein the finial support posts are metal posts and the support sleeves are made of a material softer than the support posts, and wherein the finial support posts interference fit with the support sleeves.

4. The window covering support of claim 1, wherein the finial support posts include a tapered tip for facilitating insertion of the support posts into the support sleeves.

5. The window covering support of claim 1, wherein each support sleeve includes a peripheral lip portion contacting at least a portion of the end of the support tube to prevent complete insertion of the support sleeve into the support tube.

6. A window covering support, comprising:

a support rod having first and second hollow ends;

first and second decorative finials supported on the first and second ends of the support rod, respectively, each finial including a decorative portion and a metallic support post; and first and second support sleeves disposed intermediate the first and second ends and the first and second finials respectively, the support sleeves having an outer surface conforming to an inner surface of the hollow ends and an inner surface configured to engage the support posts in an interference fit to support and retain the finials on the support rod.

7. The window covering support of claim 6, wherein the support rod is a rigid metal rod.

8. The window covering support of claim 6, wherein the support rod is an elongated tube.

9. The window covering support of claim 6, wherein the support sleeves are made of a synthetic plastic material.

10. The window covering support of claim 6, wherein each support sleeve includes an annular stop in contact with the associated end of the support rod, the annular stop limiting insertion of the support sleeves in the support rod.

11. The window covering support of claim 6, wherein the support sleeves are generally cylindrical in shape and are press fitted into the ends of the support rod.

12. A method for supporting a decorative finial on a hollow end of a support rod, comprising the steps of:

(a) providing an elongated support post extending from the finial;

(b) pressing a support sleeve into the hollow end of the support rod, the support sleeve being made of a material softer than the finial support post; and (c) pressing the finial support post into the support sleeve to establish an interference fit between the support post and the support sleeve.

13. The method of claim 12, wherein the support sleeve includes a stop extending from an outer surface thereof, the stop contacting the end of the support rod to limit insertion of the support sleeve into the support rod in step (b).

14. The method of claim 12, wherein the support post includes a tapered tip for facilitating its insertion into the support sleeve in step (c).

15. The method of claim 12, wherein the finial includes a stop, the stop contacting the support sleeve to limit insertion of the support post into the support sleeve in step (c).

* * * * *

US005642595C1

(12) EX PARTE REEXAMINATION CERTIFICATE (7786th)

United States Patent
Daniels et al.

(10) Number: US 5,642,595 C1
(45) Certificate Issued: Oct. 5, 2010

(54) FINIAL ATTACHMENT ARRANGEMENT FOR A WINDOW COVERING SUPPORT ROD

(75) Inventors: James L. Daniels, Freeport, IL (US); Christopher T. Chiles, Freeport, IL (US)

(73) Assignee: Newell Operating Company, Freeport, IL (US)

Reexamination Request:
No. 90/009,251, Aug. 15, 2008

Reexamination Certificate for:

| | |
|---|---|
| Patent No.: | **5,642,595** |
| Issued: | **Jul. 1, 1997** |
| Appl. No.: | **08/603,446** |
| Filed: | **Feb. 20, 1996** |

(51) Int. Cl.
*E04C 3/00* (2006.01)

(52) U.S. Cl. ..... 52/301; 52/745.16; 52/832; 52/848; 160/330; 211/78; 211/105.1

(58) Field of Classification Search ..... None
See application file for complete search history.

(56) References Cited

U.S. PATENT DOCUMENTS

| | | | |
|---|---|---|---|
| 2,525,736 | A | 9/1946 | Taylor |
| 2,918,841 | A | 11/1956 | Poupitch |
| 3,685,781 | A | 8/1972 | Webster |
| 3,742,809 | A | 7/1973 | Zifferer |
| 3,810,341 | A | 5/1974 | Holz |
| 3,942,407 | A | 3/1976 | Mortensen |
| 3,953,906 | A | 5/1976 | Brown |
| 4,795,074 | A | 1/1989 | Francis |
| 5,011,030 | A | 4/1991 | Alaurent |
| 5,152,631 | A | 10/1992 | Bauer |
| 5,678,703 | A | 10/1997 | Sawyer |

OTHER PUBLICATIONS

Springs Window Fashions Division, Inc. (Dec. 1994), Wrought Iron Finial Installation Instructions.

*Primary Examiner*—Joseph A. Kaufman

(57) ABSTRACT

A finial support arrangement is provided for window coverings and the like, including a hollow ended support rod or tube, a support sleeve lodged within the rod, and a decorative finial supported in and by the sleeve. The finial includes a support post that is force or interference fitted into the sleeve. The sleeve, in turn, is force or interference fitted into the tube. The sleeve is made of a material that is softer than the support post and may be deformed during insertion of the post. The arrangement is particularly useful for supporting cast or wrought metal finials in rigid support tubes or rods, and alleviates the need for close tolerances on either the tube interior diameter or the support post outer diameter that would otherwise be needed to provide the desired interference fit.

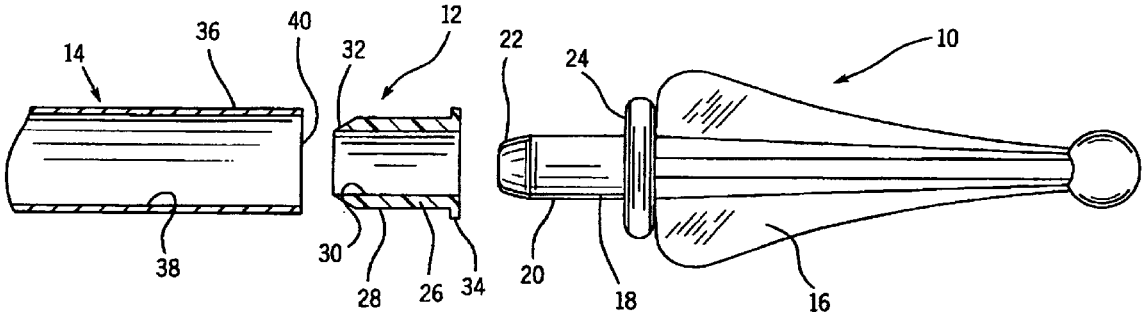

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-15 are cancelled.

* * * * *